United States Patent [19]

Thannheiser

[11] Patent Number: 4,527,306

[45] Date of Patent: Jul. 9, 1985

[54] SPINNING PREPARATION SYSTEM AND METHOD FOR AIR-CONDITIONING THE SAME

[75] Inventor: Axel Thannheiser, Moschendorf, Fed. Rep. of Germany

[73] Assignee: Trützschler GmbH & Co. KG, Monchen-Gladbach, Fed. Rep. of Germany

[21] Appl. No.: 519,478

[22] Filed: Aug. 1, 1983

[30] Foreign Application Priority Data

Jul. 31, 1982 [DE] Fed. Rep. of Germany ..... 3228672

[51] Int. Cl.[3] ..... D01G 37/00

[52] U.S. Cl. ..... 19/66 CC; 19/105

[58] Field of Search ..... 19/66 R, 66 CC, 105

[56] References Cited

U.S. PATENT DOCUMENTS 2,834,058 5/1958 Bryant ..... 19/66 CC
3,357,061 12/1967 Jackson ..... 19/66 CC
3,564,829 2/1971 Tsuzuki ..... 19/66 R
3,881,222 5/1975 Roberson ..... 19/66 R

FOREIGN PATENT DOCUMENTS 1721225 3/1956 Fed. Rep. of Germany .
2321843 11/1973 Fed. Rep. of Germany .
496926 11/1970 Switzerland .

OTHER PUBLICATIONS

Johannsen et al., "Handbuch der Baumwollspinnerei", vol. III, 5th Ed., pp. 430–438.

*Primary Examiner*—Louis K. Rimrodt
*Attorney, Agent, or Firm*—Spencer & Frank

[57] ABSTRACT

A spinning preparation system and method for air-conditioning the same wherein a spinning preparation system having a plurality of fiber processing machines connected together defines a continuous fiber transportation path. An air-conditioning system is provided which is connected in such a manner that conditioned air is delivered directly to the fiber transportation path.

27 Claims, 6 Drawing Figures

SPINNING PREPARATION SYSTEM AND METHOD FOR AIR-CONDITIONING THE SAME

BACKGROUND OF THE INVENTION

The present invention relates to a spinning preparation system and a method for air-conditioning the same, and more particularly, a spinning preparation system comprising a plurality of fiber processing machines, for example a bale opener, mixer, cleaner, tuft feeder and carding machine, which are connected together by means of fiber transporting conduits and which define a continuous fiber transportation path, wherein air leaving an air-conditioning system enters the spinning preparation system.

The air-conditioning systems for spinning preparation systems are known in the art, for example see O. Johannsen and F. Walz, Handbuch der Baumwollspinnerei [Handbook of Cotton Spinning], Volume III, 5th edition, pages 430–438. In a modern air-conditioning system the temperature and humidity of the plant are treated by a common system in such a manner that automatic regulating devices constantly keep the temperature and humidity as close as possible to the desired level within the plant, regardless of the environmental conditions and in spite of changes in the plant's interior temperature and humidity resulting primarily from the flow of air into and out of the plant.

Normally, since temperature and humidity have such an intimate physical relationship, it is natural to regulate them together. In addition to controlling the temperature and humidity of the plant, it is customary to purify the air and to add a certain amount of outside air to renew the plant air supply. The renewal air should be added to the plant without creating annoying drafts in the rooms.

The amount of heat which is released during the spinning preparation process varies with each type of machine which is present in the spinning preparation system. For example, the amount of heat released by the motors of the preliminary apparatus, such as a carding machine with flyers, is barely half the amount, relative to the floor area occupied, of that released from ring spinners. Since the air exchange required to dissipate the motor heat is substantially less, the air-conditioning system for this type of equipment could be smaller. In addition, while the air-conditioning system for cooling the ring spinning room is dimensioned primarily for the dissipation of heat, the air-conditioning system for cooling the preliminary apparatus serves not only to condition the air but also to remove dust from the room.

When air-conditioning a cotton cleaning system, the air-conditioning system in the scutcher room should also equalize the humidity, which is enhanced by the fact that air conveyance is employed such that the cotton comes into intimate contact with the conveying air on its path from the bale to the coiler or to the card feeder. The conveying air should, therefore, have, as closely as possible, a constant temperature and humidity. It is known in the art that the coils are regulated to a constant weight. However, if the humidity of the air in the room and thus the moisture content of the cotton are not kept constant, the weight of a coil does not correspond accurately to the quantity of fiber therein.

Fluctuations in the weight of cotton as it travels through the spinning preparation system are probably caused in part by the fluctuating humidity of the air at the beater. This fluctuation similarly occurs when pneumatic card feeders are used to feed a silver into a card machine.

Prior art air-conditioning systems have certain additional disadvantages. For example, the transfer of conditioned air from the air-conditioner into the room and from there to the cotton involves a certain time delay. Moreover, local variations in the room climate may exist. Additionally, a considerable volume of air is required to completely air-condition an entire plant at the levels required to efficiently operate a spinning preparation system.

SUMMARY OF THE INVENTION

It is therefore an object of the present invention to provide a method of the above mentioned type which permits a shorter air-conditioning time using a reduced volume of air and to provide an improvement in the uniformity of the air-conditioning of the textile fibers for example cotton or synthetic fibers.

This object and others, to become apparent as the specification progresses, are accomplished by the invention, according to which, briefly stated, air-conditioned air is introduced directly into the fiber material carrying regions of a spinning preparation system.

Due to the fact that the conditioned air is introduced directly into the fiber carrying regions of the spinning preparation system, for example, the machine regions, fill chutes, chambers, conduits, beater regions or the like, the entire fiber processing equipment room need not be air-conditioned which results in a considerable reduction of the volume of air that must be conditioned. In addition, the delay which results from having to transfer the conditioned air from the air-conditioning system into the room and from the room into the spinning preparation system is eliminated. Instead, in the present invention, the conditioned air directly reaches the texile fibers present in the spinning preparation system which significantly reduces the time required to condition the fibers. For example, in the case of air-conditioning the fiber tufts, the conditioning time is shortened quite drastically compared to air-conditioning the bales. Furthermore, by conditioning small areas, the uniformity of the air-conditioning of the textile fibers is improved as well, since such air-conditioning is more direct and it is possible, for example, to regulate the climate for smaller quantities of air in a shorter period of time, that is, the time it takes to effect a regulation between a measured deviation from a desired value and the setting of the corresponding value is shortened. Finally, since, as a result of fewer operators required to operate today's fully automatic spinning preparation systems, the present invention permits a reduction in the air-conditioning of entire rooms, while at the same time improving the operation of the system.

For example, in an opener and cleaner upstream of a mixer, the fresh air entering the cleaner to transport the tufts is furnished by an air-conditioner which introduces approximately 3000 to 4000 $m^3/h$ into the machine. At this point, the finely separated fiber tufts may have their first contact with conditioned air. Since the degree of separation of the tufts is high, the desired humidity and temperature conditions, in particular, can be established in an extremely short time. The tufts then travel together with the conditioned air through a fan into the mixer and, during the time the chamber is being filled, the conditioned air also flows through the mixer so that the same environment also exists in the mixer. This permits the fiber to be held in the mixer for sufficient rest or dwell periods to subject the fibers to establish conditions (moisture content, in particular) which are required for optimum processing during the spinning process. Likewise, in the openers located downstream from the mixer, for example, a fine opener, conditioned air can be introduced directly at air inlets.

When fiber tufts are fed into the carding machine or its beaters, a ventilator or fan transports the fiber tufts either from a preliminary machine or from a storage facility and, after passing through the fan, the fiber tufts are blown into a feed conduit. It is preferable according to the invention, to likewise supply the fan air supply opening with conditioned air.

Preferably, however, the air is obtained for the system directly from a central air-conditioning system. A significant feature of the invention is that the conditioned air is introduced directly into the fiber carrying regions of the spinning preparation system without first being introduced into the equipment room of the plant. Advantageously, the air is brought from individual air-conditioning units directly to the individual areas to be air-conditioned. At least two air-conditioning units can be provided for increased security against malfunction since a switch from one to the other can be made in case one malfunctions. According to a further preferred embodiment, textile aids, for example a brightener, paraffine or the like, may be mixed with the conditioned air.

The present invention also includes an apparatus for implementing the method wherein the air entrance openings of the spinning preparation system are each connected directly with an air-conditioning system, be it, for example, a central, a group or an individual air-conditioning system. Advisably, the connection is established by means of conduits, for example, pipelines. Preferably, the air entrance openings of one group of machines or of each individual machine are connected directly with an air-conditioning system. It may also be of advantage to connect an air-conditioning system to an individual or group of fiber material transport conduits which connect the fiber processing machines. The apparatus according to the present invention can be installed, for example, in older spinning plants as additional equipment where previously no air-conditioning was employed in the spinning preparation system or in the cleaning system.

In practice, bales are often conditioned by simply placing them for a longer period of time in front of the bale openers, possible in a second row parallel to the bales presently being processed. In the past, in order to obtain good spinning results, it has been necessary to expose the bales, after removal of their covers, for at least 24 hours to the climate of the processing equipment room so that they will properly adapt. According to a further preferred embodiment, the air-conditioning system is arranged to follow the bale opener. When the bale opener removes layers, flakes or tufts from the bale, the fibers are already in a relatively widely separated state. Particularly, when conditioning fiber tufts, the time required to air-condition the tufts is significantly reduced compared to the time required to air-condition the bales. It is advisable to place an air-conditioning system in front of each air intake opening of a group of fiber material transporting ventilators or fans, by providing an air-conditioning unit for each fiber material transport fan or for a group of fiber material transport fans.

Advantageously, the machine employs a tuft intake through at least one fill chute. Likewise, it is of advantage for the machine to be an opener or cleaner, including beaters and fine openers. The present invention is preferably particularly suitable for use with a mixer having at least one mixing chamber. According to a further preferred embodiment of the invention, the fiber processing machine is a tuft feeding device for a carding machine having at least one fill chute.

DESCRIPTION OF THE PREFERRED EMBODIMENTS

Figure 1:
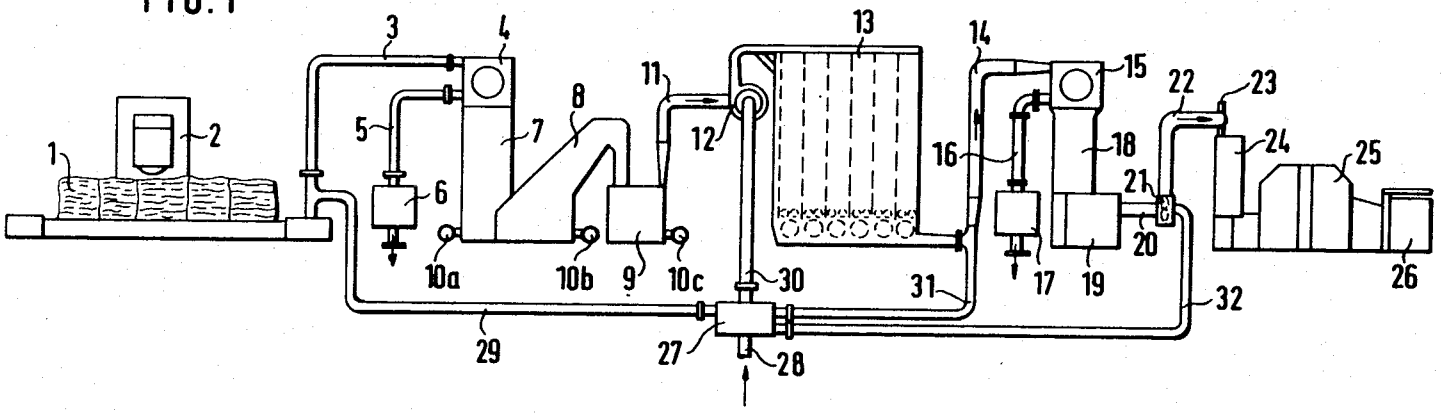
FIG. 1 is a simplified pictorial representation of a spinning preparation system with a centrally arranged air-conditioning system according to the invention.

FIG. 1 shows a cleaning line whose machines are connected together by pipelines. A series of free-standing fiber bales 1 arranged one behind the other are processed by a bale opener 2, for example a Trütschler BLENDOMAT manufactured by Trützschler GmbH & Co., Mönchengladbach, Federal Republic of Germany. The fiber tufts (not shown) which are removed from the bales by bale opener 2 are fed through a transporting conduit 3 to a condenser 4 which separates the fibers from the transporting air. The transporting air travels through a pipeline 5 and a filter 6 into the open cleaning room. The condenser 4 has an associated feeding device 7 including a fill chute for a step cleaner 8 followed by a cleaner 9, for example a sawtooth cleaner. At the lower end of feeding device 7, step cleaner 8 and cleaner 9, there are waste removal conduits 10*a*, 10*b* and 10*c*, respectively. The cleaner 9 is connected via pipeline 11 with the suction end of a transport ventilator or fan 12 which is followed by a mixer 13, for example, a multimixer having a plurality of chambers. Mixer 13 is followed by a condenser 15 connected to it by a transport conduit 14 with the fiber tufts being separated in mixer 13 by the transporting air. The transporting air is transported into the open cleaning room through a pipeline 16 and a filter 17. Condenser 15 is connected to a fine opener 19 via a feed device 18 equipped with a fill chute. The fiber tufts travel from fine opener 19 through a transporting conduit 20 into the suction side of a transporting ventilator or fan 21. The transporting ventilator is connected to a plurality of card feeders 24, via a transporting conduit 22 equipped with a distributor conduit 23 which connects conduit 22 to the plurality of card feeders 24. Feeders 24 have fill chutes, only one of which is shown. From the card feeder 24 the fiber tufts travel in condensed form as a fiber web into a carding machine 25 which produces a sliver of parallel fibers (not shown) which is deposited in a can 26 and is fed from there to the next machine in the spinning process, for example a drawing mechanism.

A central air-conditioning unit 27 including an air in-take opening 28 is connected to conduit 3 via a conduit 29, to ventilator 12 via a conduit 30, to pipeline 14 via a conduit 31, and to ventilator 21 via a conduit 32. The conditioned air leaving air-conditioning unit 27 is thus introduced directly through conduits 29, 30, 31 and 32 into fiber material carrying areas 3, 12, 14 and 21 of the system. The conditioned air thus immediately contacts the substantially separated fiber tufts. The air leaving filters 6 and 17 as exhaust air enters freely into the processing room and at least in part may be returned to the air-conditioning system 27 through air intake device 28.

Figure 2:
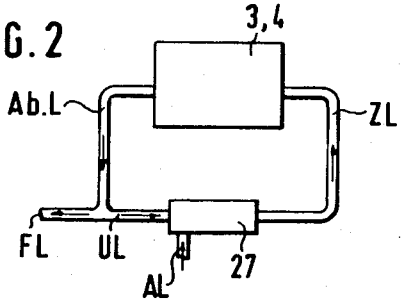
FIG. 2 is a pictorial representation of a portion of a spinning preparation system showing the direction of flow of an air-conditioning system according to the invention.

FIG. 2 is a schematic representation of a portion of a spinning preparation system showing the direction of air flow of an air-conditioning system according to the invention. In FIG. 2, air-conditioning system 27 is shown connected to conduit 3 and condenser 4 which is shown schematically as conduit-condenser 3, 4. AL indicates outside air taken in outside the system, ZL indicates conditioned air delivered from the air-conditioning system to conduit-condenser 3, 4. Ab.L indicates air removed from conduit-condenser 3, 4; FL indicates air exhausted into the room; UL represents return air to the air conditioner 27. From air-conditioning system 27, the fresh air enters a fiber material carrying region, for example, conduit-condenser 3, 4, which forms a two-part chamber, and from there travels as returned air into a return conduit and possibly a filter (not shown in FIG. 2). According to the embodiment of FIG. 2, a part (UL) of the return air is returned directly to the air-conditioning system 27, while the other part (FL) is directed into the open room in the form of exhaust air. This exhaust air may, at least in part, be returned, together with outside air, to the air-conditioning system 27.

Figure 3:
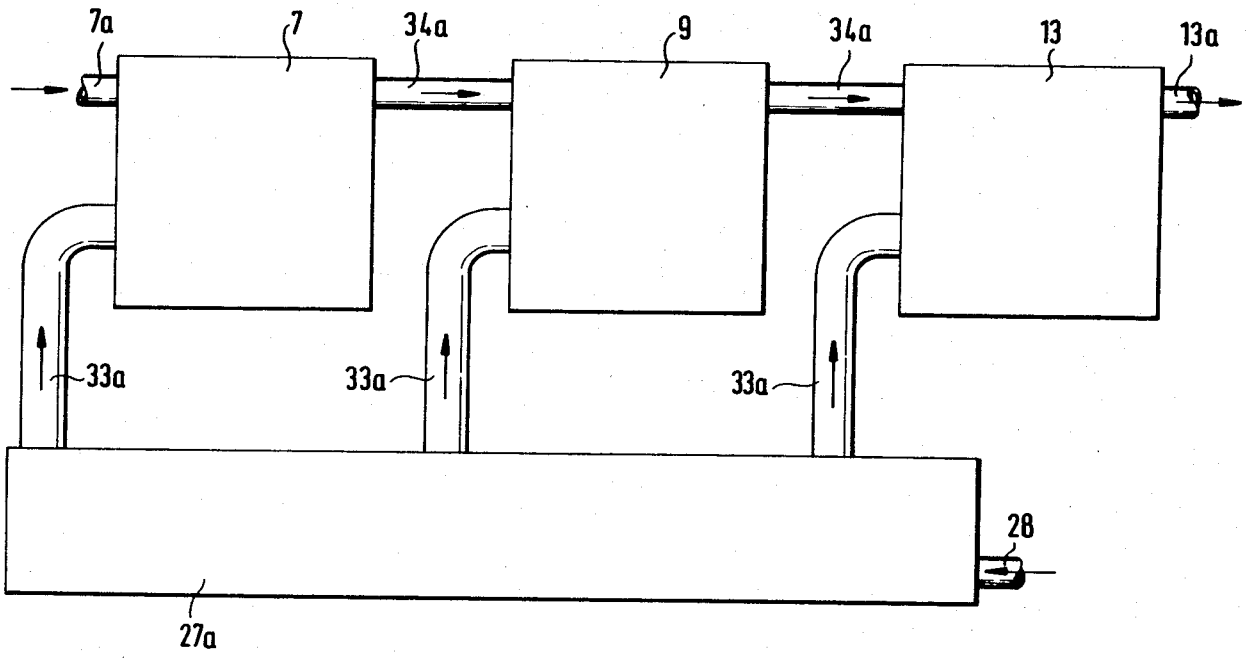
FIG. 3 is a schematic representation of a portion of a spinning preparation system with a single air-conditioning system utilized for a group of fiber processing machines.

FIG. 3 shows a feeding device 7, the cleaner 9 and mixer 13 in a row, one behind the other, within a cleaning line and connected together by means of a pipeline 34*a*. The conditioned air is introduced from a group air-conditioning system directly into the fiber material carrying regions of the feeding device 7, the cleaner 9 and mixer 13 through pipeline 33*a*. The group air-conditioning system 27*a* is associated with a plurality of fiber carrying regions, for example machines, transporting conduits, chutes or the like. While unconditioned fiber tufts enter the cleaner 7 at 7*a*, air-conditioned fiber tufts and conditioned air leave mixer 13 at 13*a*.

Figure 4:
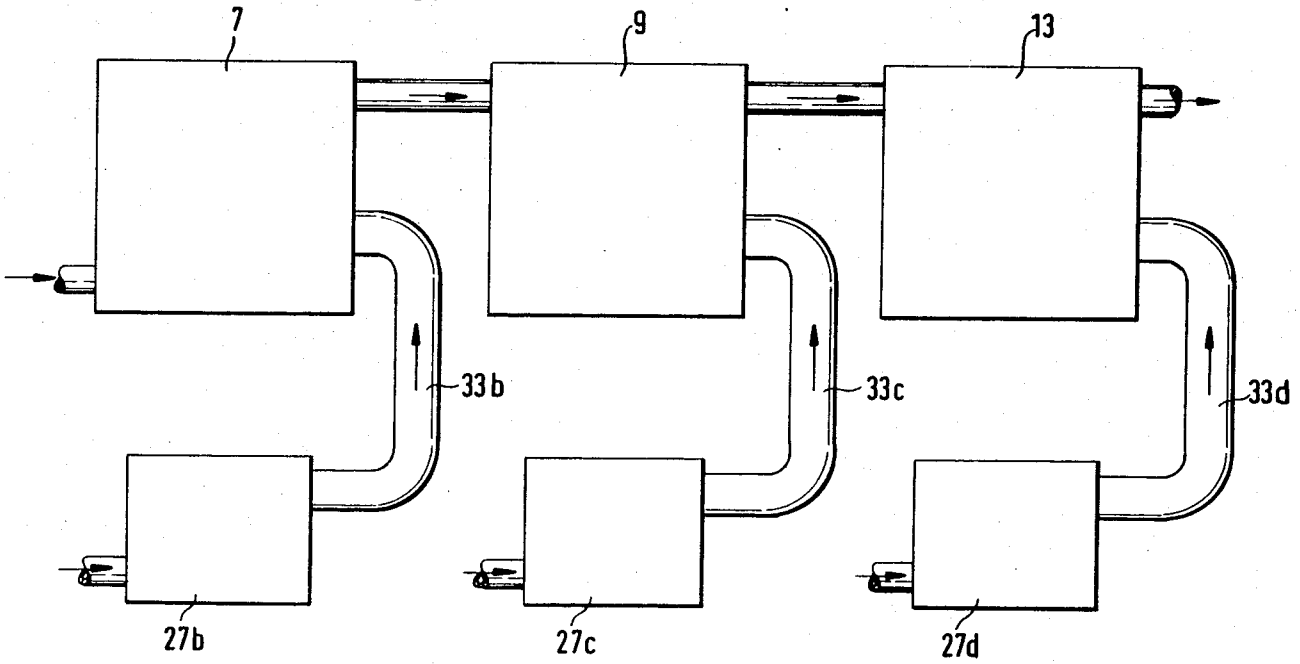
FIG. 4 is a schematic representation of a portion of a spinning preparation system utilizing individual air-conditioning systems for a group of fiber processing machines.

In FIG. 4, feeding device 7, cleaner 9 and mixer 13 are arranged one behind the other and are each connected with an individual air-conditioning system 27*b*, 27*c* and 27*d*, respectively, via pipelines 33*b*, 33*c* and 33*d*.

Figure 5:
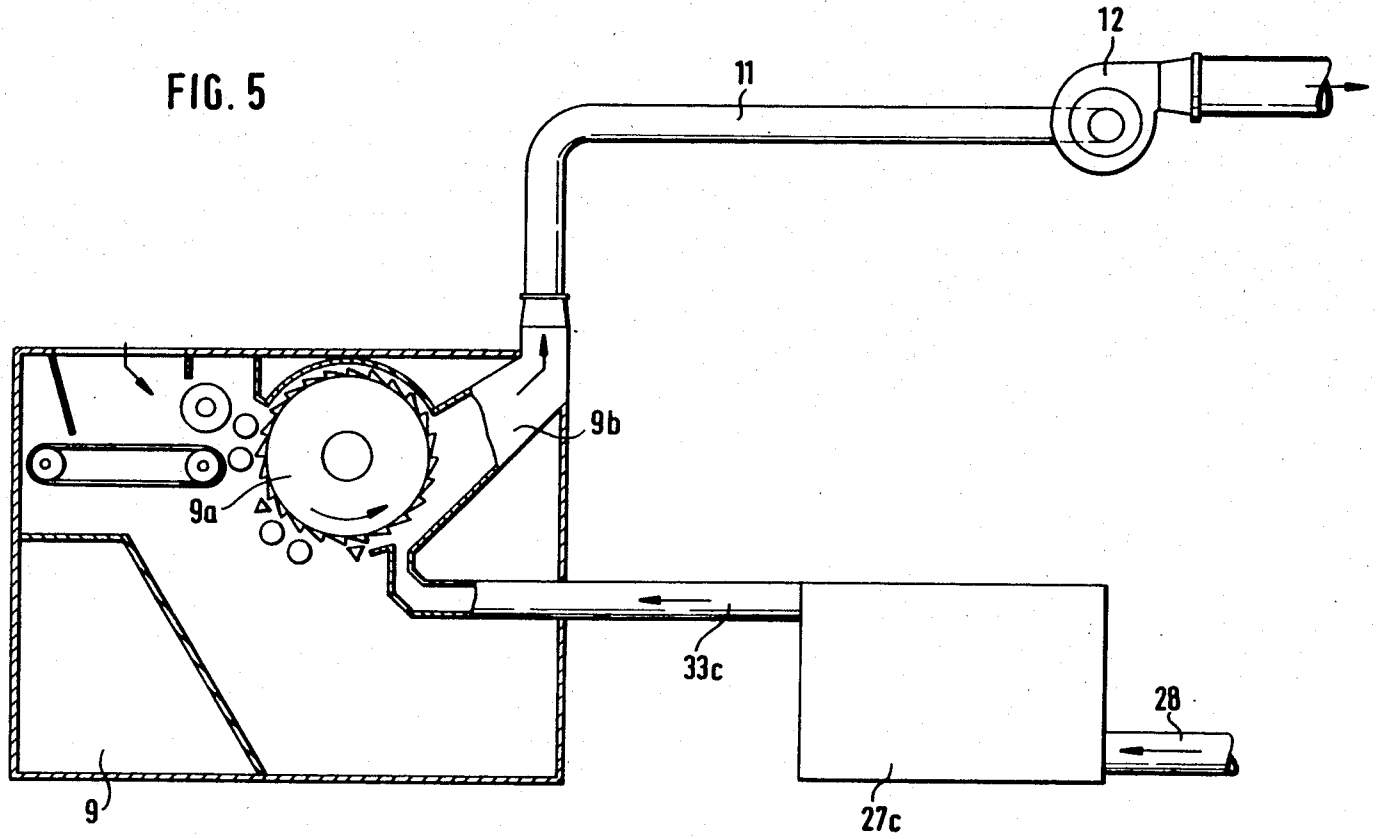
FIG. 5 is a simplified pictorial view of an individual air-conditioning system connected to a cleaner according to the invention.

According to FIG. 5 the individual air-conditioning system 27*c* is followed by sawtooth cleaner 9. The fiber tufts (not shown) travel over two intake rollers into the beating range of sawtooth drums 9*a* and are from there transferred to discharge chamber 9*b*. The conditioned air travels from individual air-conditioning system 27*c* through pipeline 33*c* into the discharge chamber 9*b* and is there mixed with the fiber tufts. The air-conditioned fiber tufts travel through pipeline 11 to the suction side of ventilator 12 and from there to be subjected to further cleaning processes.

Figure 6:
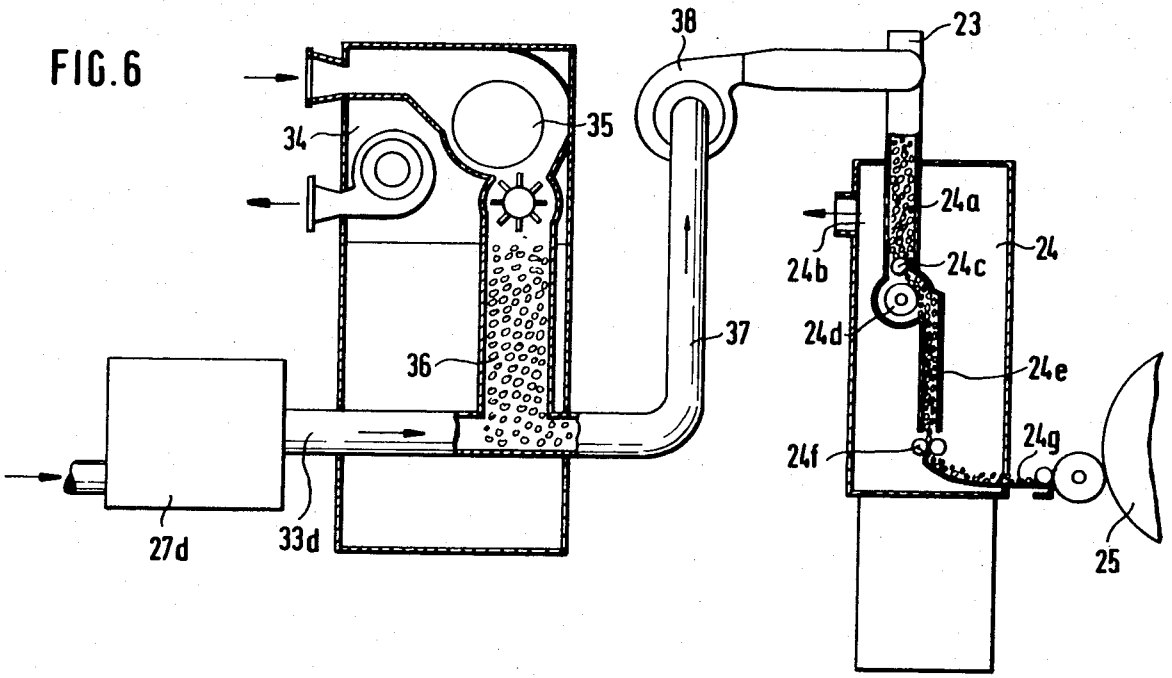
FIG. 6 is a simplified pictorial view of an individual air-conditioning system connected to a tuft filling chute according to the invention.

FIG. 6 schematically shows a tuft feeding device 34, including a condenser 35 and a tuft fill chute 36 where fiber tufts are conveyed from the top to the bottom end where they are removed. One side of the lower end of tuft chute 36 is connected, via a conduit 37, with the suction side of a ventilator or fan 38 from which the fiber tufts are fed into the common distributor conduit 23 for a plurality of card feeders 24 (only one of which is shown). The other side of the lower end of fill chute 36 is connected, via a pipeline 33*d*, with the individual air-conditioning system 27*d* from which the conditioned air is fed into fill chute 36. The fiber tufts travel from fill chute 36 into the air-conditioned stream of air and are thus mixed with the conditioned air whereupon they are transported through pipeline 37 via fan 38 into distributor conduit 23 and, from there, into the upper part of the material reserve chute 24*a* of card feeder 24. The air-conditioned transporting air passes through air exit openings 24*b* in the wall surface of reserve chute 24*a* and is exhausted into the open room, while the tufts travel over an intake roller 24*c* and an opening roller 24*d* into the lower feed chute 24*e* of card feeder 24. A filter (not shown) may be provided to filter the air prior to exhausting it into the processing room. From lower feed chute 24*e*, the tufts are removed in a known manner by delivery rollers 24*f* and are fed to the card 25 as fiber web 24*g*.

The present invention can also be used to air-condition fiber bails 1, if, for example, the fiber bales are enclosed in an appropriate housing that is to be air-conditioned. The invention also contemplates that spinning preparation machines, for example, a drawing mechanism, flyer and the like will follow the carding machine 25.

It will be understood that the above description of the present invention is susceptible to various modifications, changes and adaptations, and the same are intended to be comprehended within the meaning and range of equivalents of the appended claims.

What is claimed is:

1. In a method for air-conditioning a spinning preparation system composed of a plurality of different types of fiber processing machines that are disposed in at least one room in a spinning plant and that are connected sequentially together by means for transporting fiber in order to sequentially perform a plurality of different processes on the fiber, each processing machine of the sequence having a fiber-carrying region, wherein conditioned air leaving an air-conditioning system enters the spinning preparation system, the improvement comprising introducing conditioned air from the air-conditioning system directly into the fiber carrying region of more than one fiber processing machine of the sequence, without first circulating the conditioned air through said at least one room.

2. Method as defined in claim 1 wherein the conditioned air is supplied by a central air-conditioning system.

3. Method as defined in claim 1 wherein the conditioned air is supplied by a plurality of air-conditioning systems each supplying conditioned air to a respective fiber carrying region.

4. Method as defined in claim 1 wherein conditioned air is supplied by a plurality of air-conditioning systems each supplying conditioned air to a single fiber carrying region.

5. Method as defined in claim 1 further including the step of mixing textile aids into the conditioned air.

6. Method as defined in claim 1, wherein said means for transmitting fiber includes a conduit leading to one of the fiber processing machines, wherein the step of introducing conditioned air comprises introducing conditioned air to said one of the fiber processing machines via said conduit while simultaneously transporting fiber to said one of the processing machines through said conduit using the conditioned air, and further comprising moistening the fiber within the fiber-carrying region of said one of the fiber processing machines using only the conditioned air that is introduced thereto via said conduit.

7. Method as defined in claim 6, wherein said means for transporting fiber also includes another conduit leading to another of the fiber processing machines, wherein the step of introducing conditioned air further comprises introducing conditioned air to said another of the fiber processing machines via said another conduit while simultaneously transporting fiber to said another of the processing machines through said another conduit using the conditioned air, and further comprising moistening the fiber within the fiber carrying region of said another of the processing machines using only the conditioned air that is introduced thereto via said another conduit.

8. Method as defined in claim 6, wherein said means for transporting also includes a further conduit leading from said one of the processing machines to a further one of the processing machines, and further comprising the step of transporting fiber from said one of the processing machines to said further one of the processing machines via said further conduit using at least a portion of the air that was introduced into said one of the processing machines via said conduit.

9. Method as defined in claim 1, wherein said means for transporting fiber includes a conduit from one of the processing machines to another of the processing machines, and wherein the step of introducing conditioned air comprises introducing conditioned air into said one of the processing machines and transporting fiber from said one of the processing machines to said another of the processing machines via said conduit using at least a portion of the air introduced into said one of the processing machines.

10. A spinning preparation system for a spinning plant having at least one room, comprising: a plurality of fiber processing machines disposed in said at least one room; connection means for connecting said plurality of fiber processing machines together, said plurality of fiber processing machines and said connection means defining a continuous fiber transportation path; and an air-conditioning system for supplying conditioned air, including at least one air-conditioning unit and means for delivering conditioned air from said at least one air-conditioning unit directly to said fiber transportation path at a plurality of locations therealong so as to directly provide conditioned air to more than one fiber processing machine along the path, without first circulating the conditioned air through said at least one room.

11. The spinning preparation system of claim 10 wherein each of said plurality of fiber processing machines has an air inlet and said means for delivering conditioned air to said fiber transportation path is connected to each of said air inlets.

12. The spinning preparation system of claim 10 wherein one of said plurality of fiber processing machines is a bale opener and said air-conditioning system is disposed down stream of said bale opener.

13. The spinning preparation system of claim 10 further comprising at least one ventilator having an air inlet opening for transporting fiber material along said fiber transportation path and wherein said means for delivering conditioned air to said fiber transportation path is connected to said air inlet opening.

14. The spinning preparation system of claim 10 wherein one of said plurality of fiber processing machines is a tuft feeding device having at least one fill chute.

15. The spinning preparation system of claim 10 wherein one of said plurality of fiber processing machines is a bale opener.

16. The spinning preparation system of claim 10 wherein one of said plurality of fiber processing machines is a cleaner.

17. The spinning preparation system of claim 10 wherein one of said plurality of fiber processing machines is a mixer having at least one mixing chamber.

18. The spinning preparation system of claim 10 wherein one of said plurality of fiber processing machines is a tuft feeding device for a carding machine having at least one fill chute.

19. The spinning preparation system of claim 10, wherein said at least one air-conditioning unit is a central air-conditioning unit.

20. The spinning preparation system of claim 10, wherein at least one of the processing machines on said fiber transportation path has an air inlet and an air outlet that is on said fiber transportation path, wherein said means for delivering conditioned air is connected to said air inlet, and wherein at least a portion of the conditioned air delivered at said air inlet is used to transport fiber through said air outlet.

21. The spinning preparation system of claim 10, wherein at least one of the processing machines on said fiber transportation path has an air inlet that is also on said fiber transportation path, wherein said means for delivering conditioned air is connected to said air inlet and transports fiber thereto, and wherein all of the moisture introduced into said at least one processing machine enters through said air inlet.

22. A spinning preparation method for bringing the moisture content of fibers to a predetermined level as the fibers are transported through a spinning preparation system having a plurality of fiber processing machines disposed in at least one room of a plant, connection means for connecting the fiber processing machines in a sequence to provide a continuous fiber transportation path through the fiber processing machines, and air conditioning means for supplying conditioned air, comprising the steps of:

delivering conditioned air from the air conditioning means directly to the fiber transportation path, without first introducing the conditioned air to said at least one room;

blowing the fibers with conditioned air along a portion of the fiber transportation path and into one of the fiber processing machines in the sequence; and moistening the fibers as they are blown along said portion of the fiber transportation path and into said one of the fiber processing machines using only the conditioned air.

23. The spinning preparation method of claim 22, further comprising blowing the fibers with conditioned air along a further portion of the transportation path from said one of the fiber processing machines in the sequence and into the next fiber processing machine in the sequence.

24. The spinning preparation method for claim 23, further comprising moistening the fibers as they are blown along said further portion of the fiber transportation path and into said next fiber processing machine in the sequence using only the conditioned air.

25. The spinning preparation method of claim 24, wherein said means for supplying conditioned air is a central air conditioning unit and wherein the step of delivering conditioned air comprises injecting air from said central air conditioning unit into said portion of the fiber transportation path and into said further portion of the fiber transportation path.

26. The spinning preparation method of claim 24, wherein said means for supplying conditioned air is a group air conditioning unit and wherein the step of delivering conditioned air comprises injecting air from said group air conditioning unit into said one of the fiber processing machines in the sequence and said next fiber processing machine in the sequence.

27. The spinning preparation method of claim 24, wherein said means for supplying conditioned air is individual air conditioning units and wherein the step of delivering conditioned air comprises injecting air from one of the individual air conditioning units into said one of the fiber processing machines in the sequence and injecting air from another of the individual air conditioning units into said next fiber processing machine in the sequence.

* * * * *